US005400766A

United States Patent [19]

Dillon

[11] Patent Number: 5,400,766

[45] Date of Patent: Mar. 28, 1995

[54] GAS APPLIANCE STOVE SAFETY VALVE SYSTEM

[76] Inventor: John A. Dillon, 2817 West Ave., K-12 #153, Lancaster, Calif. 93536

[21] Appl. No.: 161,569

[22] Filed: Dec. 6, 1993

[51] Int. Cl.[6] ..... F24C 3/12

[52] U.S. Cl. ..... 126/42; 137/384.2; 70/177

[58] Field of Search ..... 126/42, 39 R; 137/385, 137/384.2, 359; 70/176, 177

[56] References Cited

U.S. PATENT DOCUMENTS

| | | | |
|---|---|---|---|
| 623,331 | 4/1899 | McOsker et al. | 126/42 |
| 2,413,237 | 12/1946 | Jones | 126/42 |
| 2,489,611 | 11/1949 | Becvar | 137/385 |

FOREIGN PATENT DOCUMENTS

| | | | |
|---|---|---|---|
| 598197 | 5/1934 | Germany | 126/42 |

*Primary Examiner*—James C. Yeung
*Attorney, Agent, or Firm*—Charles C. Logan, II

[57] ABSTRACT

A gas appliance stove safety valve system that incorporates a safety valve assembly between the gas line manifold of the stove and the wall shut-off valve from the main gas line. The safety valve assembly is mounted adjacent the rear of the gas appliance stove beneath an aperture in its top wall. Special structure is utilized to fasten the ball valve assembly to the top wall of the stove. A special key is utilized that can be inserted through the aperture in the top wall of the stove to rotate the valve stem of the ball valve assembly between a closed position and an open position. There is also structure for preventing removal of the key unless the safety valve assembly is actuated to its shut-off position.

6 Claims, 1 Drawing Sheet

GAS APPLIANCE STOVE SAFETY VALVE SYSTEM

DESCRIPTION OF THE PREFERRED EMBODIMENT

The invention relates to a gas appliance stove such as found in the kitchen of a home and more specifically to a safety valve system for preventing children and senile adults from accidently turning on the burners of the stove.

The majority of gas appliance stoves have burner knobs mounted on the front wall of the stove. The height of these burner knobs puts them within hand reach of small children. Small children have a frequent habit of turning knobs not knowing the consequences of their actions. This can result in the burners being lit or in some cases resulting in a continuous flow of natural or propane gas that has not been lit. This can later result in an explosion, causing great damage and possible loss of life or limb. Older adults that are senile or diagnosed with Alzheimers disease are like young children. They are not responsible for their acts such as turning stove burners on. The results can be minor or cause major damage such as fire or explosions.

It is an object of the invention to provide a novel gas appliance stove safety valve system that has the safety valve assembly positioned adjacent the rear of the stove on its top wall out the reach of children.

It is also an object of the invention to provide a novel gas appliance stove safety valve system that is installed intermediate the gas manifold of the stove and the wall shut-off valve for the main gas line.

It is another object of the invention to provide a novel gas appliance stove safety valve system that has a safety valve assembly which can be shut-off by a key that is removed when the stove is not being used.

It is an additional object of the invention to provide a novel gas appliance stove safety valve system that has a safety valve assembly that is actuated with a key and the key cannot not be removed unless the valve has been turned to a closed position.

It is a further object of the invention to provide a novel gas appliance stove safety valve system that is economical to manufacture and market.

It is also an object of the invention to provide a novel gas appliance stove safety valve system that is easily installed.

SUMMARY OF THE INVENTION

The novel gas appliance stove safety valve system is usable with conventional gas appliance stoves and gas appliance counter top stoves. The first step in its installation involves removing the gas line from the wall shut-off valve. Next an aperture having a predetermined diameter is formed in the top wall of the gas appliance stove. A ball valve assembly then has its outlet end connected to the gas line running to the gas line manifold of the stove. Also a new gas appliance connector hose is connected between the wall shut-off valve and the inlet end of the ball valve assembly. This completes the flow path of the supply of gas to the gas burners.

The ball valve assembly has a neck portion having an internally threaded bore. A square shaped rotatable valve stem extends upwardly from the neck portion and it is aligned beneath the aperture that has been formed in the top wall of the stove. A washer is positioned over the aperture and a fastener nut having a threaded shank has its bottom end threaded into the internally threaded neck portion of the ball valve assembly. A shoulder on the fastener nut bears against the top surface of the washer and prevents the fastener nut from passing through the aperture of the washer. As the fastener nut is tightened it will draw the ball valve assembly snugly against the bottom surface of the top wall of the gas appliance stove.

The washer has an annular ridge on its outer surface with an alignment notch therein. A cover cap has a radially inwardly extending alignment finger that mates with the alignment notch on the washer as the cover cap is snapped onto the washer. The key for actuating the ball valve assembly has a shank portion with an annular foot portion formed on its bottom end. The foot portion has a square shaped recess that mates with the square shaped rotatable valve stem of the ball valve assembly. Also extending laterally from the shank portion is a finger which aligns with a radial slot formed in the top surface of the cover cap and allows the key to be inserted therein. In this position the gas flow is turned off in the ball valve assembly. Rotation of the key 90 degrees will open the valve allowing for gas to travel therethrough. At this point the gas appliance stove can be used in its normal manner and all of the burner knobs would function to turn on gas to the individual gas burners. Before the person using the stove can remove the key from the ball valve assembly, it must be rotated 90 degrees to the off position. It therefore provides a positive reminder to the person using the stove that the stove will be inoperable by anyone, such as a child, if the key has been removed. The key would be then kept in a safe place where a child could not reach it.

DESCRIPTION OF THE PREFERRED EMBODIMENT

Figure 1:
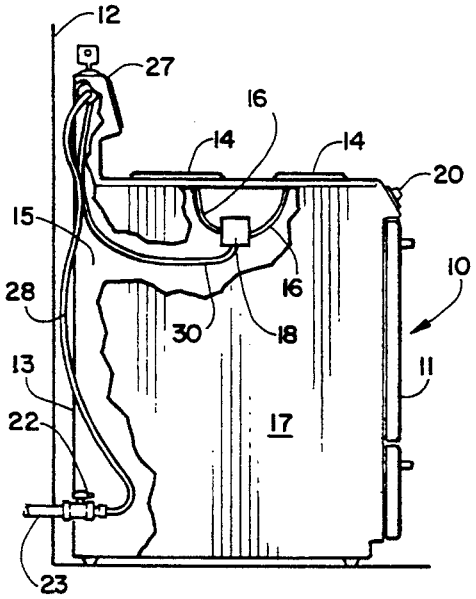
FIG. 1 is a schematic side elevation showing the manner in which the gas appliance stove safety valve system is installed.

The novel gas appliance stove safety valve system will now be described by referring to FIGS. 1–5 of the drawing.

In FIG. 1 a conventional gas appliance stove 10 is mounted adjacent a kitchen wall 12. Stove 10 has a front wall 11, a rear wall 13, laterally spaced side walls 15 and 17, and a top wall 27. Stove 10 has a plurality of gas burners 14 connected by gas line 16 to a manifold 18. A plurality of burner knobs 20 are mounted on the front of the stove. A wall shut-off valve 22 is connected to the main gas line 23. A ball valve assembly 25 is mounted adjacent to top wall 27 of stove 10. A gas appliance connector hose 28 is connected between wall shut-off valve 22 and ball valve assembly 25. A gas line 30 is connected between ball valve assembly 25 and gas line manifold 18.

Figure 2:
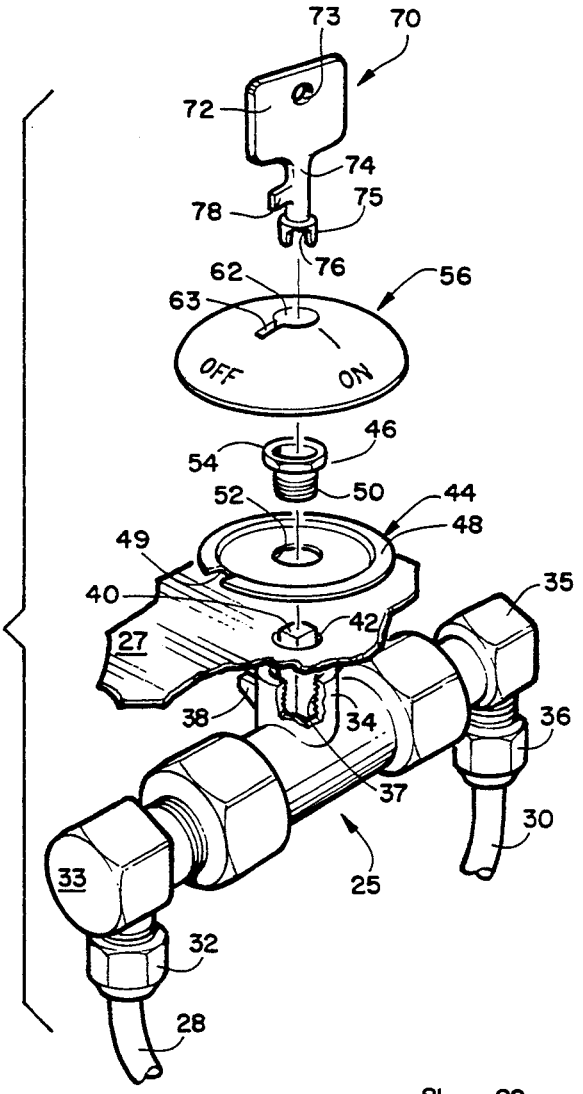
FIG. 2 is an exploded front perspective view showing the ball valve assembly and the structure for mounting it on the top of a stove and also for actuating the valve.
Figure 3:
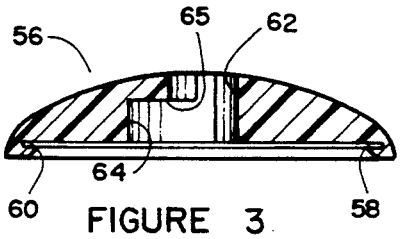
FIG. 3 is a cross sectional view of the cover cap.
Figure 4:
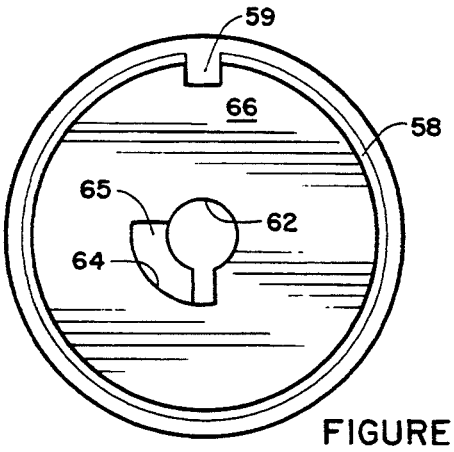
FIG. 4 is a bottom plan view of the cover cap.

The specific structure of ball valve assembly 25 and the structure for mounting it on top wall 27 is best illustrated in FIGS. 2–4. Ball valve assembly 25 has the following structure: an inlet compression nut 32, a left elbow coupling 33, a neck portion 34, a right elbow coupling 35, and an outlet compression nut 36. Threaded neck portion 34 has an alignment finger 38 and has an internally threaded bore 37. A rotatable valve stem 40 extends upwardly from neck portion 34 and would be aligned with aperture 42 in top wall 27.

The structure for securing ball valve assembly 25 to top wall 27 is washer 44 and fastener nut 46. Washer 44 has an annular ridge 48 having an alignment notch 49. The threaded shank 50 of fastener nut 46 passes through aperture 52 but shoulder 54 is too wide to pass therethrough. When fastener nut 46 is threaded into the threaded bore 37 of neck portion 34, ball valve assembly is drawn upwardly against the bottom surface of top wall 27 and fixedly secured thereto.

The bottom of cover cap 56 has an annular cam surface 58 with an alignment finger 59 extending radially therefrom. Alignment finger 59 is aligned with alignment notch 49 and cover cap 56 is snapped onto the annular ridge 48 of washer 44 and seats in annular groove 60. This insures that the cover cap is properly oriented with its off and on positions. Cover cap 56 has a central aperture 62 in communication with radial slot 63. A recess 64 extends laterally from the interior of aperture 62. It has a top wall 65. This along with bottom wall 66 of cover cap 56 is clearly illustrated in FIGS. 3 and 4.

A key 70 has a head portion 72 having an aperture 73 for hanging the key. It also has a shank portion 74 and an annular foot portion 75 that has a square shaped recess 76. A finger 78 extends laterally from shank portion 74 so that the key can only be installed or removed in cover cap 56 in one position. This means that if the key has been actuated to open ball valve assembly 25, it cannot be removed. It would remain in this position while a person is using the gas appliance stove. Once they are finished using the stove they have to turn the key to the off position which closes the ball valve assembly before it can be removed.

Figure 5:
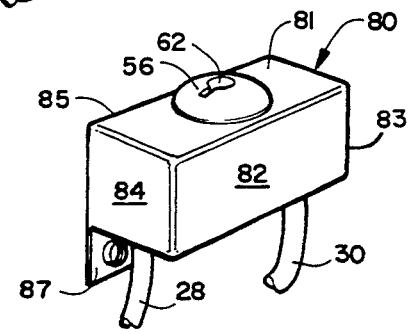
FIG. 5 is an alternative embodiment that shows the ball valve assembly mounted in a housing separate from the top of the stove and making it possible to mount it to the wall of the kitchen.

An alternative embodiment is illustrated in FIG. 5 that shows a different structure in which the ball valve assembly 25 can be mounted. The structure is a ball valve assembly mounting housing 80 that could be mounted on the kitchen wall 12. It has a top wall 81, a front wall 82, a right side wall 83, a left side wall 84 a rear wall 85 and a mounting flange 87. It would have the same cover cap 56, washer 44, and fastener nut 46 for attaching the ball valve assembly to the bottom surface of top wall 81.

What is claimed is:

1. A gas appliance stove safety valve system comprising:

a gas appliance stove having a front wall, a rear wall, a top wall, and laterally spaced side walls; said gas appliance stove having a plurality of gas burners that are connected to a gas line manifold, said top wall having an aperture therein;

a main gas line having a wall shutoff valve;

a safety valve assembly having an inlet end and an outlet end and being mounted beneath the aperture in the top wall of said gas appliance stove; said safety valve assembly having an upstanding neck portion with an internally threaded bore and a rotatable valve stem extends upwardly from said neck portion; and means for securing said safety valve assembly to the top wall of said gas appliance stove comprising a washer having a central aperture and a fastener nut having a shoulder adjacent its top end and a threaded shank portion that is removably threaded into the bore in the neck portion of said ball valve assembly;

a gas connector hose having an inlet end and an outlet end, said inlet end being connected to said wall shutoff valve and said outlet end being connected to the inlet end of said safety valve assembly;

a gas line having an inlet end and an outlet end, said inlet end being connected to the outlet end of said safety valve assembly and said outlet end being connected to said gas line manifold; and means for actuating said safety valve assembly from outside the top wall of said gas appliance stove.

2. A gas appliance stove safety valve system as recited in claim 1 further comprising a cover cap that is removably secured to said washer.

3. A gas appliance stove safety valve system as recited in claim 1 wherein said means for actuating said safety valve assembly is a key having a shank portion with an annular foot portion, said foot portion having a bore configured to mate with said rotatable valve stem.

4. A gas appliance stove safety valve system as recited in claim 3 further comprising means for preventing removal of said key unless said safety valve assembly is actuated to its shutoff position.

5. A gas appliance stove safety valve system comprising:

a gas appliance stove having a front wall, a rear wall, a top wall, and laterally spaced side walls; said gas appliance stove having a plurality of gas burners that are connected to a gas line manifold, said top wall having an aperture therein adjacent said rear wall and it has a vertical axis;

a main gas line having a wall shutoff valve;

a safety valve assembly having an inlet end and an outlet end and being mounted beneath the aperture in the top wall of said gas appliance stove; said safety valve assembly having a vertically oriented upstanding neck portion with an internally threaded bore and a vertically oriented rotatable valve stem extends upwardly from said neck portion and there are means for securing said safety valve assembly to the top wall of said gas appliances rove;

a gas connector hose having an inlet end and an outlet end, said inlet end being connected to said wall shutoff valve and said outlet end being connected to the inlet end of said safety valve assembly;

a gas line having an inlet end and an outlet end, said inlet end being connected to the outlet end of said safety valve assembly and said outlet end being connected to said gas line manifold; and means for actuating said safety valve assembly from outside the top wall of said gas appliance stove comprising a vertically oriented key having a shank portion with an annular foot portion, said foot portion having a bore configured to mate with said rotatable valve stem.

6. A gas appliance stove safety valve system as recited in claim 5 further comprising means for preventing removal of said key unless said safety valve assembly is actuated to its shutoff position.

* * * * *